US005413325A

United States Patent [19]

Dubois et al.

[11] Patent Number: 5,413,325

[45] Date of Patent: May 9, 1995

[54] METHOD FOR DISASSEMBLING SHEETS OF PAPER

[75] Inventors: Eric Dubois, Bourg-les-Valence; André Nicolet, Beauvallon, both of France

[73] Assignee: Monetel S.A., Granges-les-Valence, France

[21] Appl. No.: 98,385

[22] PCT Filed: Dec. 14, 1992

[86] PCT No.: PCT/FR92/01180

§ 371 Date: Jun. 27, 1994

§ 102(e) Date: Jun. 27, 1994

[87] PCT Pub. No.: WO93/12023

PCT Pub. Date: Jun. 24, 1993

[30] Foreign Application Priority Data

Dec. 13, 1991 [FR] France ..... 91 15835

[51] Int. Cl.[6] ..... B65H 3/00

[52] U.S. Cl. ..... 271/121; 271/127; 271/225; 271/149

[58] Field of Search ..... 271/121, 124, 125, 126, 271/127, 303, 225, 149

[56] References Cited

U.S. PATENT DOCUMENTS 3,539,179 11/1970 Bergman ..... 271/124
4,496,145 1/1985 Fukui .
4,852,868 8/1989 Fukui et al. .
4,982,942 1/1991 Konishi et al. ..... 271/121
5,083,765 1/1992 Kringel ..... 271/126
5,244,191 9/1993 Kanekura ..... 271/126
5,316,284 5/1994 Bolognese et al. ..... 271/121

FOREIGN PATENT DOCUMENTS 0329035 8/1989 European Pat. Off. .
0445029 9/1991 European Pat. Off. .
0452961 10/1991 European Pat. Off. .

*Primary Examiner*—H. Grant Skaggs
*Attorney, Agent, or Firm*—Lowe, Price, LeBlanc & Becker

[57] ABSTRACT

A device for unpiling sheets one at a time from a pile of sheets placed perpendicular to a supporting surface, includes a pressure arm engaging a first face of the pile. A single friction drive roller has an axis perpendicular to the supporting surface, arranged at a predetermined distance from the supporting surface. The second face of the pile is engaged with the roller along a first edge. A low-friction abutment is arranged in the vicinity of the roller, separated from the supporting surface by the roller and has a surface parallel to the roller axis and offset relative to the roller. A pad is disposed substantially perpendicular to the supporting surface and is movable towards the abutment along a second edge located downstream of the first edge.

9 Claims, 3 Drawing Sheets

METHOD FOR DISASSEMBLING SHEETS OF PAPER

The present invention relates to a device for removing sheets one at a time from a pile of sheets, and more particularly to such a device in which the pile is vertically disposed and in which all the sheets may not have the same height and/or same width.

Many apparatuses, such as photocopiers, printers, etc, use horizontal unpiling devices. U.S. Pat. No. 4,852,868 describes such a device. The device includes a pressure arm that urges a pile of sheets towards a first friction drive roller. The friction drive roller draws the sheets towards a second friction drive roller that rotates in the same direction and is applied against a counter-rotating roller.

In devices for unpiling vertical piles of sheets, the known used in horizontal unpiling devices or less reliable single roller mechanisms are often used.

In addition to their complexity, and therefore to their high cost, a drawback of the conventional unpiling devices is that they draw the sheets such as they are oriented in the pile. This drawback is particularly critical in apparatuses designed for the processing of bank checks, for example, because the height of the checks is often different and some checks may be misaligned with the rest of the pile. If the misaligned checks are not correctly realigned, their processing (bar-code reading, printing of characters) may be carried out in bad conditions.

An object of the invention is to provide a vertical unpiling device having a particularly simple structure.

A further object of the invention is to provide an unpiling device operable to realign misaligned sheets.

These objects are achieved with a device for removing sheets one at a time from a pile of sheets placed perpendicularly to a supporting plane, including a pressure arm engaging a first face of the pile; a single friction drive roller having an axis perpendicular to the supporting plane, arranged at a predetermined distance from the supporting plane, the second face of the pile being engaged with the roller along a first edge; a low-friction abutment arranged in the vicinity of the roller, opposite the supporting plane, and includes a surface parallel to the roller axis and offset relative to the roller; and a pad substantially perpendicular to the supporting plane and yieldingly urged toward the abutment along a second edge that is located beyond the first edge.

According to an embodiment of the invention, the abutment includes a shoulder protruding towards the sheets, opposite to the friction drive roller.

According to an embodiment of the invention, the pad includes a facet that is practically tangent to the surface of the abutment at the second edge.

According to an embodiment of the invention, the pressure arm is loosely articulated along an axis perpendicular to the supporting plane, a spring pressing on the arm in the vicinity of the friction drive roller.

According to an embodiment of the invention, the pad is articulated along an axis that is parallel to the supporting plane so as to ensure a linear contact of the pad with the abutment.

According to an embodiment of the invention, the abutment is an idle roller that is arranged coaxially to the friction drive roller and has a smaller diameter.

According to an embodiment of the invention, the shoulder is a shoulder of the idle roller.

According to an embodiment of the invention, the unpiling device includes a routing device that is articulated about an axis perpendicular to the supporting plane and includes a free extremity urged towards a guiding plate of the sheets that are drawn by the friction drive roller.

According to an embodiment of the invention, the free extremity of the routing device includes fingers parallel to the supporting plane, whose distal extremities are retractable into corresponding recesses provided in the guiding plate.

The foregoing and other objects, features, aspects and advantages of the invention will become apparent from the following detailed description of the present invention when taken in conjunction with the accompanying drawings.

An embodiment of an unpiling device according to the invention will be described hereinafter with reference to FIGS. 1A, 1B, 2A, 2B and 3, simultaneously. This embodiment will be described with reference to an exemplary device for unpiling bank checks.

Figure 1A:
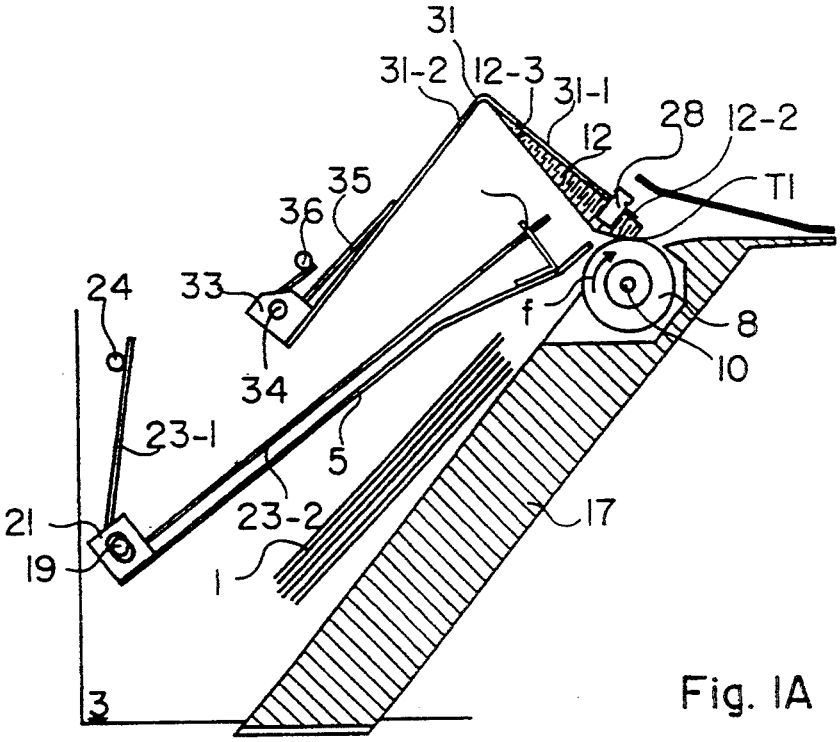
FIGS. 1A and 1B are top cross-sectional views along line A—A and line B—B of FIG. 2B, respectively, of an embodiment of an unpiling device according to the invention.

A pile of checks 1, shown in FIG. 1A, is vertically laid on a supporting plate 3 and is manually inserted 15 between a free end era pressure arm 5 and rollers 7, 8 having a common vertical axis 10. The free end of the pressure arm 5 is yieldingly urged toward the rollers; thus, if the rollers rotate in the sense of an arrow f, it is obvious that the first check of the pile tends to be drawn by the rollers. However, the first check may draw along other checks by friction. Those other checks are stopped by a vertical pad 12 that is yieldingly urged toward the rollers on the same side as the pressure arm 5.

Figure 2A:
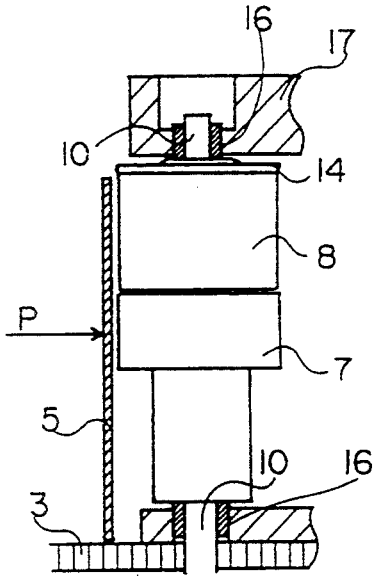
FIGS. 2A and 2B are two enlarged views of a portion of the unpiling device of FIGS. 1A and 1B, seen along arrows F1 and F2, respectively, in FIG. 1B.
Figure 2B:
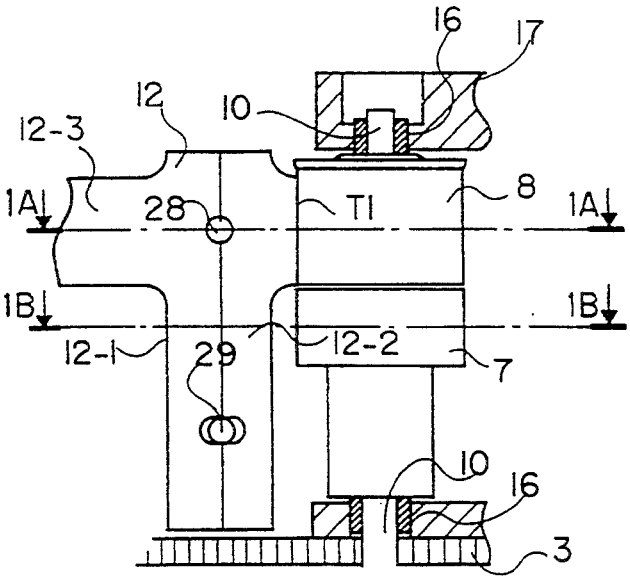

Roller 7 is a friction drive roller made of a material having, with respect to a paper sheet, a high friction coefficient and is integral with axis 10 that is driven by a mechanism (not shown), disposed beneath plate 3. As represented in FIGS. 2A and 2B, roller 7 is of small thickness and is placed substantially at half height of roller 12 and arm 5. The height of pad 12 and arm 5 is approximately equal to half the height of an average check.

Roller 8, placed above roller 7, is an idle roller, i.e., it freely rotates about axis 10. The diameter of roller 8 is slightly smaller than the diameter of roller 7. Thus, the checks are preferentially pressed against roller 7 so as to provide a more efficient driving.

The fact that roller 8 is not driven causes an asymmetrical configuration which has the advantage of realigning checks that are not correctly horizontally placed in pile 1. Additionally, this configuration compensates possible perpendicularity defects of axis 10 of the rollers, which would cause the checks to be pressed against the supporting plane 3, or to be drawn away from this plate.

The fact that roller 8 is idle causes a small progression resistance of the checks. If its external surface is of a low friction material, roller 8 could be fixed, and even be replaced by a rounded portion of the frame in the check contact area.

The upper portion of roller 8 includes a shoulder 14 protruding with respect to the roller and having a diameter equal, for example, to the diameter of the friction drive roller 7. The function of the shoulder will be described later.

As shown in FIGS. 2A and 2B, axis 10 is guided in bearings 16 that are integral with a frame 17, fixed on plate 3. Frame 17 also serves as a vertical guide for a face of the pile of checks 1.

Figure 3:
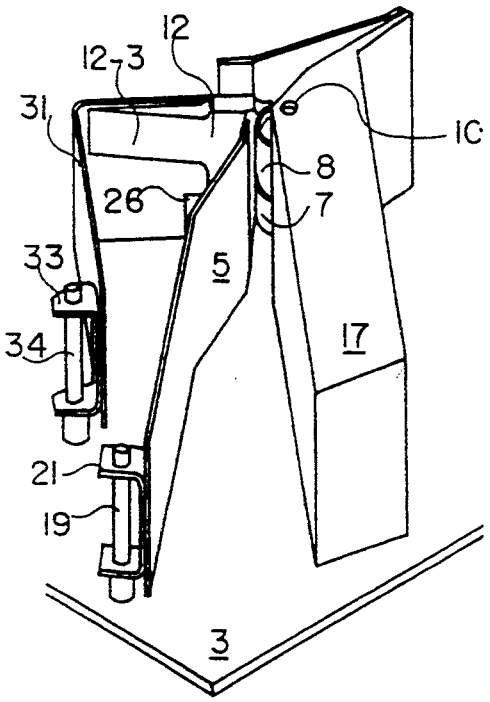
FIG. 3 is a perspective view of the unpiling device of FIGS. 1A and 1B.

As shown in FIGS. 2A and 3, the pressure arm 5 is substantially shaped like a vertical plate. Its furthermost end from rollers 7 and 8 is articulated about a vertical axis 19 passing through horizontal eyelets 21 that are integral with pressure arm 5. One of the eyelets, here the upper eyelet shown in FIGS. 7A and 3, is an oblong hole that is perpendicular to the pressure arm 5, which allows a certain rotation freedom about a horizontal axis parallel to arm 5. Therefore, arm 5 is uniformly applied onto the pile of checks. As shown in FIG. 2A, a pressure P is exerted on the free end of arm 5 in the vicinity of the center of roller 7. Pressure P is provided by a spiral spring 23 wound about axis 19. Spring 23 includes both a short arm 23-7 abutting against a pin 24 that is fixed on plate 3, and a long arm 23-2 abutting in the vicinity of the free end of the pressure arm 5 by means of a part 26 integral with pressure arm 5.

Figure 1B:
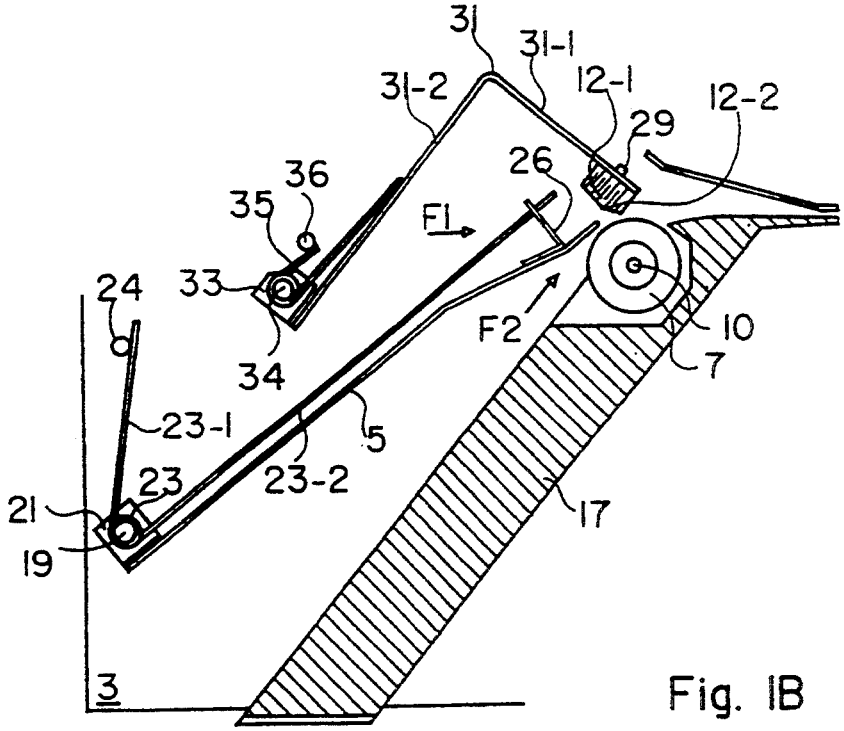

As shown in FIG. 2B, pad 12 includes a vertical portion 12-1 that has the same height as the pressure arm 5 and serves as a main abutment for the pile of checks. The vertical portion 12-1 includes a facet 12-2 that is practically tangent to the idle roller 8 along an edge T1 and is hollowed in order not to contact the friction drive roller 7. Edge T1 is disposed slightly beyond the edge T2 where the checks first contact the rollers. A portion 12-3 of pad 12, near the idle roller, extends to the left and serves as a support for a particularly thick pile of checks. Portion 12-3 gradually narrows as the distance from facet 12-2 increases in order to leave some clearance at the free end of pressure arm 5 so that it can tangentially contact rollers 7 and 8. As shown in FIG. 1B, the vertical portion 12-1 prolongs the form of portion 12-3 downwards.

In order to always have pad 12 linearly contacting roller 8 in the vicinity of edge T1, pad 12 is articulated about a horizontal axis 28. The rotation of pad 12 about axis 28 is limited by a pin 29 that is placed beneath axis 28 in a horizontal hole of vertical portion 12-1.

As shown in FIGS. 1A and 1B, a vertical metal sheet 31 folded at a right angle includes an arm 31-1 (in which are mounted axis 28 and pin 29) that is perpendicular to the pile of checks 1, and an arm 31-2 parallel to the pile of checks. The extremity of arm 31-2 is articulated by means of horizontal eyelets 33 through which a vertical axis 34 passes. Pad 12 is urged towards roller 8 by a spiral spring 35 wound about axis 34. Spring 35 includes two arms abutting between the arm 31-2 of the right-angle folded metal sheet 31 and a pin 36 fixed on plate 3.

Figure 4:
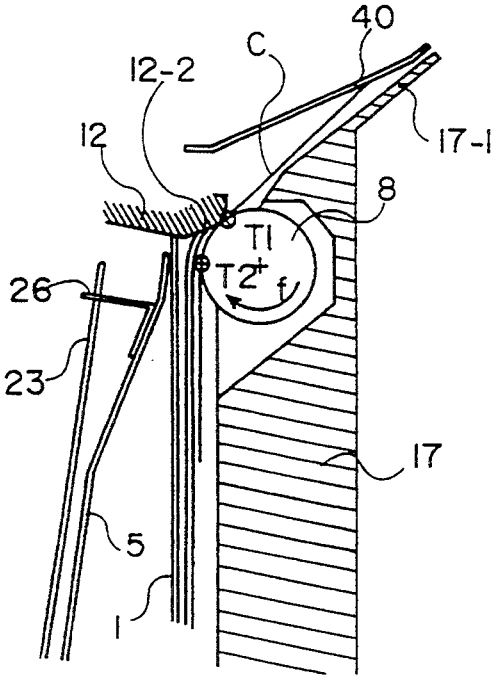
FIG. 4 is an enlarged top view of the main elements of the unpiling device of FIGS. 1A and 1B during an unpiling step.

FIG. 4, that is a partial view of FIG. 1A, represents a pile of checks 1 that is being unpiled.

Figure 5:
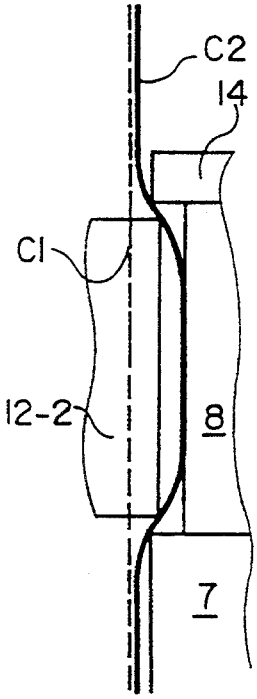
FIG. 5 is a front view of the main elements of FIG. 4 during an unpiling step.

FIG. 5 is a partial view of FIG. 2B during the passage of a check in the vicinity of edge T1 contacting pad 12 and the idle roller 8. FIG. 5 is not drawn to scale and, more particularly, the size of some elements have been enlarged for clarity.

The first check C of the pile goes along the following path.

It contacts rollers 7 and 8 near the tangent line T2 between the rollers and pile 1, and is drawn by the friction drive roller 7, in the direction indicated by arrow f.

It contacts the facet 12-2 of pad 12. The inclination of the facet 12-2 guides the extremity of check C toward edge T1 in the vicinity of which check C comes out tangentially to roller 8. Pad 12 tends to retain the checks near edge T1, and it is only the check directly drawn by roller 7 that crosses edge T1 due to the high adherence of roller 7. Check C is bent according to the arc T1, T2, which tends to unstick it from another check that could have been drawn along. Before check C passes beyond edge T1, it takes a position C1 (shown in dashed lines in FIG. 5) where it contacts the friction drive roller 7 and shoulder 74 of roller 8. Since roller 8 has a smaller diameter than the friction drive roller 7, check C does mot contact roller 8 at edge T2.

It passes beyond edge T1. The facet 12-2 of pad 12 presses the check C toward the idle roller 8 thus causing the check to be indented and to take a position C2 shown in FIG. 4 (check C is curved in transition areas, one between shoulder 14 and roller 8, and another between rollers 7 and 8). This indentation helps to unstick check C from the next check that is then in position C1. The bending and indentation of check C substantially decrease the risk that several checks simultaneously come out in the vicinity of edge T1. The omission of shoulder 14 would however still provide an indentation in the transition area between rollers 7 and 8.

It arrives at a vertical guiding plate 40 that is substantially parallel to facet 12-2. Plate 40 and an extension 17-1 of frame 17, that is substantially parallel to plate 40, guide check C, for example, toward a processing device (not shown), provided in the prolongation of plate 40 and extension 17-7.

Once the rear of check C has been drawn by the vicinity of edge T1, the next check starts being drawn, and so forth.

The device according to the invention is particularly simple and reliable. Additionally, as mentioned above, the advantage of its asymmetrical configuration is to allow a realignment of checks that are not horizontally placed in the pile and to compensate a possible perpendicularity defect of roller axis 10.

Figure 6:
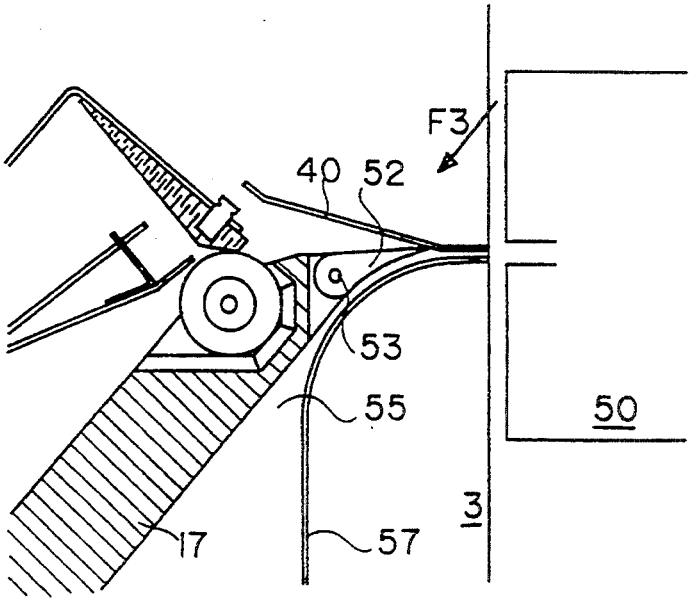
FIG. 6 is a partial top view of an alternative embodiment of an unpiling device according to the invention.

FIG. 6 schematically illustrates an alternative embodiment according to the invention of the check unpiling device that is coupled to a check processing device 50. Device 50 receives checks coming out of the unpiling device and carries out, on each check, operations that may require a to-and-fro movement of the check. If device 50 is placed not far enough from the unpiling device, the checks that are moving backward may abut against elements of the unpiling device, and then get jammed or crumpled.

To avoid having to position the processing device 50 too far away, and thus to limit the volume occupied by the device, the unpiling device includes a routing device 52 replacing extension 17-1 (refer to FIG. 4). The routing device 52 is shaped like a wedge whose thicker portion is near frame 17 and thinner portion near plate 40. The routing device 52 is articulated about a vertical axis 53 at its thicker portion and its thinner portion is urged by a spring (not shown) against plate 40. Thus, for example, a check that arrived in the processing device 50 and is undergoing a to-and-fro movement therein, will, during a backward movement, slide along the routing device 52. The check is then guided toward a separate recess 55 that is delimited by frame 17 and a vertical plate 57. The check can then freely move to-and-fro without abutting against the elements of the unpiling device; additionally, it is useless to provide a distance substantially equal to the check's length between the unpiling device and the processing device 50. Recess 55 also serves to manually insert checks directly into the processing device 50.

Figure 7:
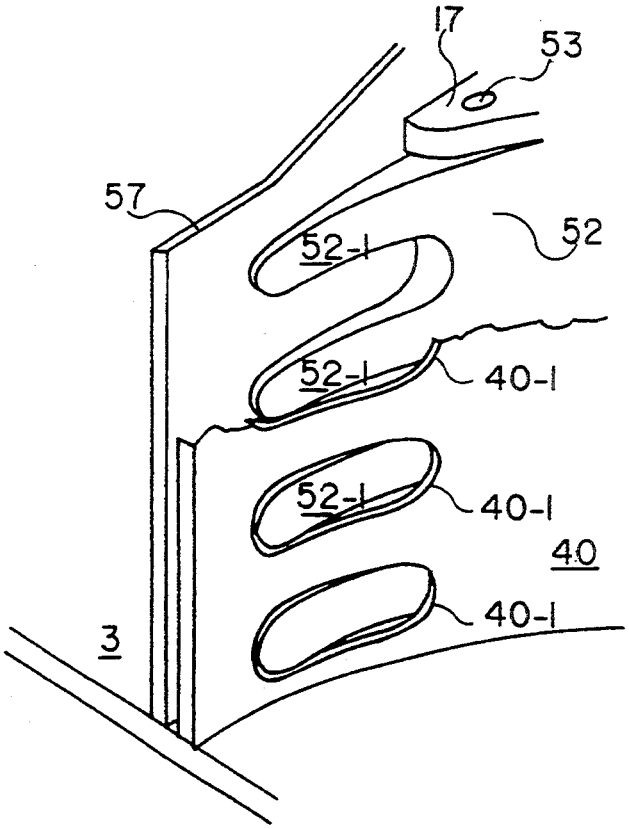
FIG. 7 is a perspective view of the unpiling device of FIG. 6, indicated by an arrow F3.

FIG. 7 is a partial perspective view of the device of FIG. 6 seen along an arrow F3. Same elements as in FIG. 5 are designated with same reference numerals. A portion of plate 40 is not shown in order to better show the routing device 52 placed behind it.

As represented, plate 40 includes a series of horizontal oblong holes that are vertically aligned. The routing device 52 includes fingers 52-1 extending horizontally in register with the oblong holes 40-1. When the routing device 52 abuts against plate 40, fingers 52-1 enter in the oblong holes 40-1 and abut against the periphery of the oblong holes at their proximal ends. Thus, the distal ends of fingers 52-1 are retracted into the oblong holes 40-1.

Such a configuration allows a check to easily pass from the unpiling device towards the processing device 50. Additionally, the retractable fingers 52-1 do not hinder the checks moving backwards towards recess 55 from the processing device 50.

Such a routing device can be used in numerous alternative applications where objects can pass through the routing device and come back in reverse direction.

As is apparent to those skilled in the art, various modifications can be made to the above disclosed preferred embodiments, more particularly in what concerns the mechanical assembling methods and the selection of materials. The unpiling device according to the invention can also be used to unpile horizontal piles by rotating the device by 90°.

Having thus described one particular embodiment of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is not intended as limiting. The invention is limited only as defined in the following claims and the equivalents thereto.

We claim:

1. A device for unpiling sheets one at a time from a pile of sheets placed perpendicular to a supporting surface, including:

a pressure arm engaging a first face of the pile;

a single friction drive roller having an axis perpendicular to said supporting surface, and arranged at a predetermined distance from the supporting surface, a second face of the pile being engaged with the roller along a first edge;

a low-friction abutment arranged proximate to the roller, separated from the supporting surface by the roller and including a surface parallel to the roller axis and offset relative to the roller; and a pad substantially perpendicular to the supporting surface and movable towards said abutment along a second edge located downstream of the first edge.

2. The unpiling device of claim 1, wherein said abutment includes a shoulder protruding towards the sheets, and opposed to said friction drive roller.

3. The unpiling device of claim 1, wherein said pad includes a facet that is substantially tangential to the surface of said abutment at the second edge.

4. The unpiling device of claim 1, wherein said pressure arm is rotatable about an axis perpendicular to the supporting surface, a spring exerts a force on the arm at a location proximate to said friction drive roller.

5. The unpiling device of claim 1, wherein said pad is rotatable about an axis parallel to said supporting surface so as to ensure a linear contact of the pad with the abutment.

6. The unpiling device of claim 1, wherein said abutment is an idle roller that is arranged coaxially to said friction drive roller and has a diameter smaller than that of said friction drive roller.

7. The unpiling device of claim 6, wherein said idle roller includes a shoulder protruding towards the sheets, and opposed to said friction drive roller.

8. The unpiling device of claim 1, including a routing device rotatable about an axis perpendicular to said supporting surface and including a free end movable towards a guiding plate for guiding the sheets drawn by said friction drive roller.

9. The unpiling device of claim 8, wherein the free end of said routing device includes finger portions parallel to said supporting surface having distal ends which are retractable into corresponding recesses provided in said guiding plate.

* * * * *